US011022066B2

(12) United States Patent
Nojeh et al.

(10) Patent No.: US 11,022,066 B2
(45) Date of Patent: Jun. 1, 2021

(54) ACTUATOR DEVICE UTILIZING RADIATIVE COOLING

(71) Applicant: The University of British Columbia, Vancouver (CA)

(72) Inventors: Alireza Nojeh, Vancouver (CA); Lorne A. Whitehead, Vancouver (CA)

(73) Assignee: The University of British Columbia, Vancouver (CA)

( * ) Notice: Subject to any disclaimer, the term of this patent is extended or adjusted under 35 U.S.C. 154(b) by 0 days.

(21) Appl. No.: 16/818,279

(22) Filed: Mar. 13, 2020

(65) Prior Publication Data

US 2020/0291888 A1 Sep. 17, 2020

Related U.S. Application Data

(60) Provisional application No. 62/819,087, filed on Mar. 15, 2019.

(51) Int. Cl.
*F02G 1/04* (2006.01)

(52) U.S. Cl.
CPC ..... *F02G 1/04* (2013.01); *F02G 2256/00* (2013.01)

(58) Field of Classification Search
CPC ..... F02G 2256/00; F02G 2258/80
USPC ..... 123/559.1, 18 R–18 A, 200–249, 123/43 R–45 A, 560–566
See application file for complete search history.

(56) References Cited

U.S. PATENT DOCUMENTS 4,452,047 A 6/1984 Hunt et al.
4,816,121 A * 3/1989 Keefer ..... B21D 39/04 204/156
8,397,498 B2 3/2013 Penciu
8,454,321 B2 6/2013 Ingersoll et al.
(Continued)

OTHER PUBLICATIONS

Fei W., et al., "Low-voltage Driven Graphene Foam Thermoacoustic Speaker." Small, May 2015, vol. 11 (19 ), pp. 2252-2256.
(Continued)

*Primary Examiner* — Shafiq Mian
(74) *Attorney, Agent, or Firm* — Borden Ladner Gervais LLP; Todd Keeler

(57) ABSTRACT

An actuator device includes a housing that defines an enclosed volume region, the housing comprising a movable surface such that at least a portion of the housing is expandable between an expanded state to a contracted state, and the enclosed volume region having a characteristic dimension that is defined as a cube root of an average of a volume of the enclosed volume region in the expanded state and in the contracted state, a working fluid within the enclosed volumetric region, the working fluid comprising a substantially transparent compressible fluid and electromagnetic (EM) radiation-absorbing solid elements distributed within the compressible fluid, wherein the solid elements have an absorptivity in a particular range of EM radiation wavelengths, a heating system for directing thermal energy into the working fluid at predetermined times, and wherein the housing includes an EM radiation transmitting portion having a sufficient area and a sufficient transparency such that more than 25% of the thermal energy directed into the working fluid by the heating means is radiative emitted through the EM radiation transmitting portion as black body EM radiation emitted by the solid elements of the working fluid.

22 Claims, 3 Drawing Sheets

(56) References Cited

U.S. PATENT DOCUMENTS

| | | | | |
|---|---|---|---|---|
| 8,459,028 | B2 * | 6/2013 | Klassen | F03G 7/04 60/645 |
| 2008/0199701 | A1 * | 8/2008 | Kuehnle | A61K 8/29 428/403 |
| 2008/0276615 | A1 * | 11/2008 | Bennett | F01L 3/20 60/614 |
| 2011/0277472 | A1 | 11/2011 | Chae | |

OTHER PUBLICATIONS

Nojeh A., et al., "Graphene-based bidirectional radiative thermal transfer method for heat engines," Applied optics, Mar. 2019, vol. 58 (8), pp. 2028-2032.

* cited by examiner

ACTUATOR DEVICE UTILIZING RADIATIVE COOLING

FIELD

The present disclosure relates to an actuator device that utilizes radiative cooling.

BACKGROUND

Heat engines are ubiquitous in modern society. They span a wide range of sizes and shapes, and all involve inducing temperature variations in a working fluid. The temperature variations result in pressure variations and volume changes whereby thermal energy is in part converted into mechanical work. This mechanical work may be utilized for a variety of purposes including, for example, moving an external system by utilizing the heat engine as an actuator.

One of the key limitations of heat engines is the time required to transfer heat into and out of the gaseous working fluid, which is limited by the poor thermal conductivity of gases. One solution that avoids this input conductivity problem is provided by utilizing an open thermal dynamic cycle by injecting pre-heated steam or a combustible mixture that is subsequently ignited into a cylinder, such as for example in steam engines and internal combustion engines. Further, these heat engines solve the output conductivity problem by discarding the working fluid from the cylinder with each cycle.

Improvements in heating and cooling working fluids in heat engines are desirable.

BRIEF DESCRIPTION OF THE DRAWINGS

Embodiments of the present disclosure will now be described, by way of example only, with reference to the attached Figures.

DETAILED DESCRIPTION

Figure 1A:
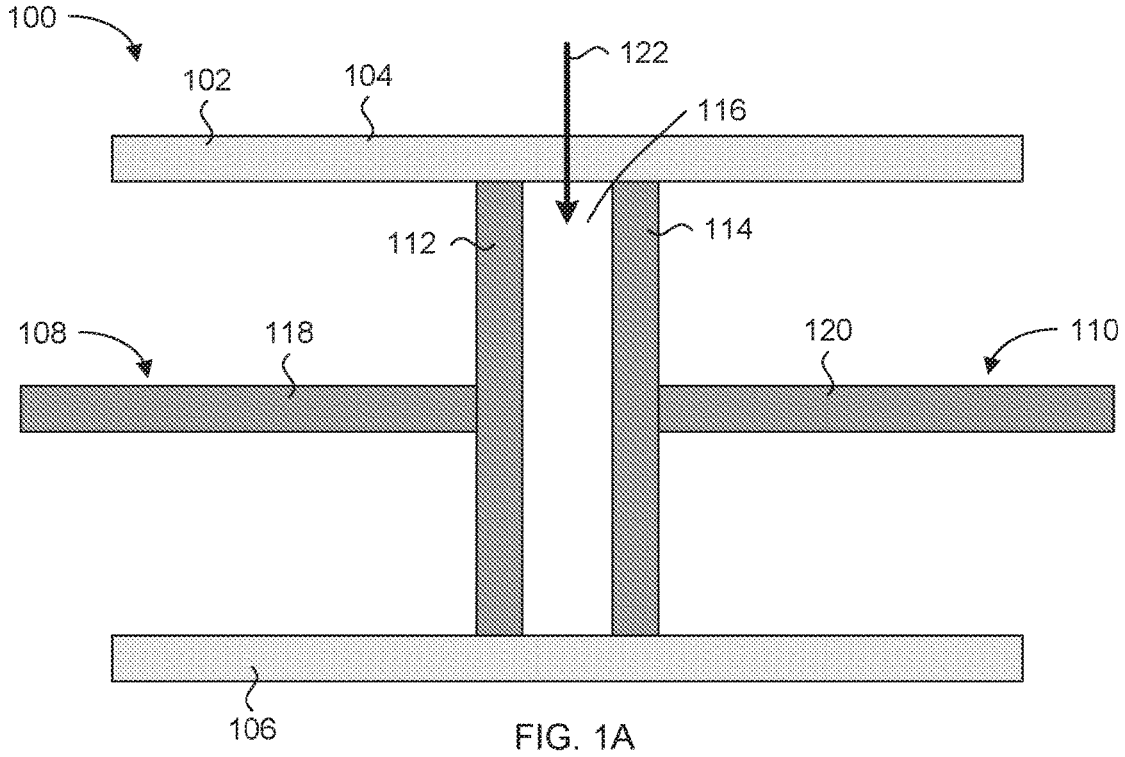
FIGS. 1A and 1B are a cross-sectional view of an example actuator device according to an embodiment of the present disclosure in a contracted state and an expanded state, respectively.

Embodiments of the present disclosure relate to actuator devices that operate as a heat engine that utilizes direct thermal radiation exchange between a working fluid of the actuator and the external environment in order to radiatively cool the working fluid.

In an embodiment, the present disclosure provides an actuator device that includes a housing that defines an enclosed volume region, the housing comprising a movable surface such that at least a portion of the housing is expandable between an expanded state to a contracted state, and the enclosed volume region having a characteristic dimension that is defined as a cube root of an average of a volume of the enclosed volume region in the expanded state and in the contracted state, a working fluid within the enclosed volumetric region, the working fluid comprising a substantially transparent compressible fluid and electromagnetic (EM) radiation-absorbing solid elements distributed within the compressible fluid, wherein the solid elements have an absorptivity in a particular range of EM radiation wavelengths, and wherein the solid elements have a thickness substantially less than the inverse of the absorptivity and occupy a fraction of the enclosed volume that is of the order of the inverse of the product of the absorptivity and the characteristic dimension of the enclosed volume region, a heating system for directing thermal energy into the working fluid at predetermined times, and wherein the housing includes an EM radiation transmitting portion having a sufficient area and a sufficient transparency such that more than 25% of the thermal energy directed into the working fluid by the heating means is radiatively emitted through the EM radiation transmitting portion as black body EM radiation emitted by the solid elements of the working fluid.

In an example embodiment, the movable surface comprises a plunger moveable within the housing, wherein the plunger and the housing define the enclosed volume region.

In an example embodiment, the plunger is substantially transparent to the EM radiation emitted from the absorptive material such that the plunger forms at least a portion of the EM radiation transmitting portion.

In an example embodiment, the actuator device includes a seal disposed between the plunger and the rest of the housing to inhibit the working fluid from leaking out of the enclosed volume region.

In an example embodiment, the seal comprises a bellows formed of a deformable material.

In an example embodiment, the solid elements comprise a substantially one-dimensional (1D) material.

In an example embodiment, the substantially 1D material is at least one of tungsten nanotubes and carbon nanotubes.

In an example embodiment, the solid elements comprise a substantially two-dimensional (2D) material.

In an example embodiment, the substantially 2D material comprises graphene sheets.

In an example embodiment, wherein the graphene sheets comprise at least one of ordered graphene sheets and disordered graphene sheets.

In an example embodiment, the graphene sheets are separated by spacers.

In an example embodiment, wherein the spacers comprise a substantially one-dimensional (1D) material.

In an example embodiment, the 1D material comprises nanotubes.

In an example embodiment, the actuator device includes a control unit connected to the heating system to control the heating of the working fluid provided by the heating system.

In an example embodiment, the heating system is configured to provide EM radiation to the working fluid to radiatively heat the working fluid during the expansion stage, and the control unit is configured to control the EM radiation provided by the heating system.

In an example embodiment, the heating system includes at least one of an incandescent lamp, a light emitting diode, a gas discharge lamp, and a laser as a source of EM radiation.

In an example embodiment, the control unit is configured to control the heating provided by the heating system to heat the working fluid periodically at a predetermined period.

In an example embodiment, the control unit is configured to control the heating provided by the heating system to heat the working fluid non-cyclically to produce expansion of the working fluid by a controlled amount during the expansion stage.

In an example embodiment, the working fluid is electrically conductive, and the heating system is configured to provide an electronic current through the working fluid to resistively heat the working fluid during the expansion stage.

In an example embodiment, the solid elements comprise graphene sponge.

In an example embodiment, during operation, the working fluid is heated to a first temperature, averaged over the enclosed volume region, to move the housing from the contracted state to the expanded state, and is cooled to a second temperature that is less than the first temperature, averaged over the enclosed volume region, to move the housing from the expanded state to the contracted state, and the absorptivity is greater than $10^6$ $m^{-1}$ and the particular range of EM radiation wavelengths is a range from one-half of a peak emission wavelength of a black body radiator at a temperature that is an average of the first and second temperatures to twice the peak emission wavelength.

In an example embodiment, an average physical separation between solid elements in the working fluid is such that the thermal equilibration time between the solid elements and the compressible fluid is substantially less than the time required for black body radiation emitted from the solid elements to reduce the absolute temperature of the working fluid by 25%.

Generally, a heat engine accepts thermal energy $Q_h$ from a thermal reservoir having an absolute temperature $T_h$ and applies most of it to a working fluid that performs net mechanical work W on an external system. The residual energy, $Q_c=Q_h-W$, is released as heat into a thermal reservoir at a lower temperature $T_c$.

Closed cycle heat engines reuse the same working fluid in each cycle. Generally, there are two goals for such an engine: a) to maximize the efficiency of conversion of heat to mechanical work, e, as defined by:

$$e = \frac{W}{Q_h}, \qquad \text{Equation 1}$$

and b) to maximize the specific power, $P_s$, which is the ratio of the average power of the engine to its mass, as defined by:

$$P_s = \frac{fW}{m} = \frac{feQ_h}{m}, \qquad \text{Equation 2}$$

where f is the cycle frequency and m is the mass of the engine.

Generally, the efficiency is intermediate between 0 and the theoretical maximum value given by:

$$e_{max} = 1 - \frac{T_c}{T_h}. \qquad \text{Equation 3}$$

This theoretical maximum efficiency can only be achieved in the limit as the cycle frequency f→0 and, according to Eq. (2), the specific power in that case also approaches 0, showing that goals (a) and (b) are not mutually compatible. As a result, there is an optimum cycle frequency $f_{opt}$ that yields the maximum specific power for a given heat engine. This can be calculated for a model Carnot engine that has thermal conductance values α and β between the working fluid and, respectively, the input and output thermal reservoirs. The optimal efficiency is independent of α and β, and takes the form of:

$$e_{opt} = 1 - \sqrt{\frac{T_c}{T_h}}. \qquad \text{Equation 4}$$

At the optimum frequency, the specific power is given by:

$$P_{s_{opt}} = k\frac{\alpha\beta}{\sqrt{\alpha^2+\beta^2}}. \qquad \text{Equation 5}$$

The value k depends on the details of the cycle, Eq. 5 shows that the maximum specific power improves approximately in proportion to conductivities α and β. Therefore, providing a heat engine with the highest possible specific power is providing by utilizing a working fluid having the highest possible values for a α and β. However, providing a gaseous working fluid with high values for α and β is challenging because gases generally have very low thermal conductivity, effectively limiting α and β, and as a result the specific power. However, gases have the advantage of large thermal expansivity, but they have very low thermal conductivity.

Therefore, it would be desired to have a suitable working fluid for a heat engine that has the expansivity of a gas but with high values of α and β, in order to increase the specific power achievable by the heat engine compared to conventional gases. As noted previously, previous attempts to address this issue by utilizing an open thermodynamic cycle, rather than a closed thermodynamic cycle, by injecting pre-heated steam, such as in a steam engine, or a combustible mixture that is then ignited, such as in an internal combustion engine, and then discarding the working fluid in each cycle.

Conventional closed thermodynamic cycles have been provided by a Sterling engine in which the working fluid is reused by cyclically forcing it through a regenerative heat exchanger in which the gas passes through such that the heat from the working fluid is transferred by conductive heating and removed from the system. The heat exchangers typically involve forcing the working fluid through narrow passages in order to reduce the required thermal conduction distance and thus effectively increasing the values of α and β. However, such heat exchangers typically add considerable mass to the overall engine, and forcing the working fluid through narrow passages introduces aerodynamic drag, both of which reduce efficiency of the engine and result in Stirling engines that generally have low specific power.

According to the present disclosure, an actuator is described in which heating and cooling of a working fluid is provided by bidirectional thermal radiation transfer between the working fluid and the environment external to the actuator.

In order for such actuators to be sufficiently practical, it is desirable to select a working fluid for which the absorption length for Planckian radiation corresponding to $T_h$ to be of the order of the diameter of the working fluid volume. If the absorption length is much shorter than that, the heat will not penetrate into the full volume of the working fluid and if the absorption length is much longer, little absorption will occur.

The present disclosure describes a suitable working fluid as comprising a compressible fluid, such as for example, an inert gas, having a suspension of solid elements that are distributed within the compressible fluid.

The solid elements may be selected to have a desired absorptivity for a particular range of wavelengths of electromagnetic (EM) radiation, have a thickness that is substantially less than the inverse of the absorptivity, and occupy a fraction of the volume of the working fluid that is of the order of the product of the absorptivity and a characteristic dimension of the heat engine.

Figure 1B:
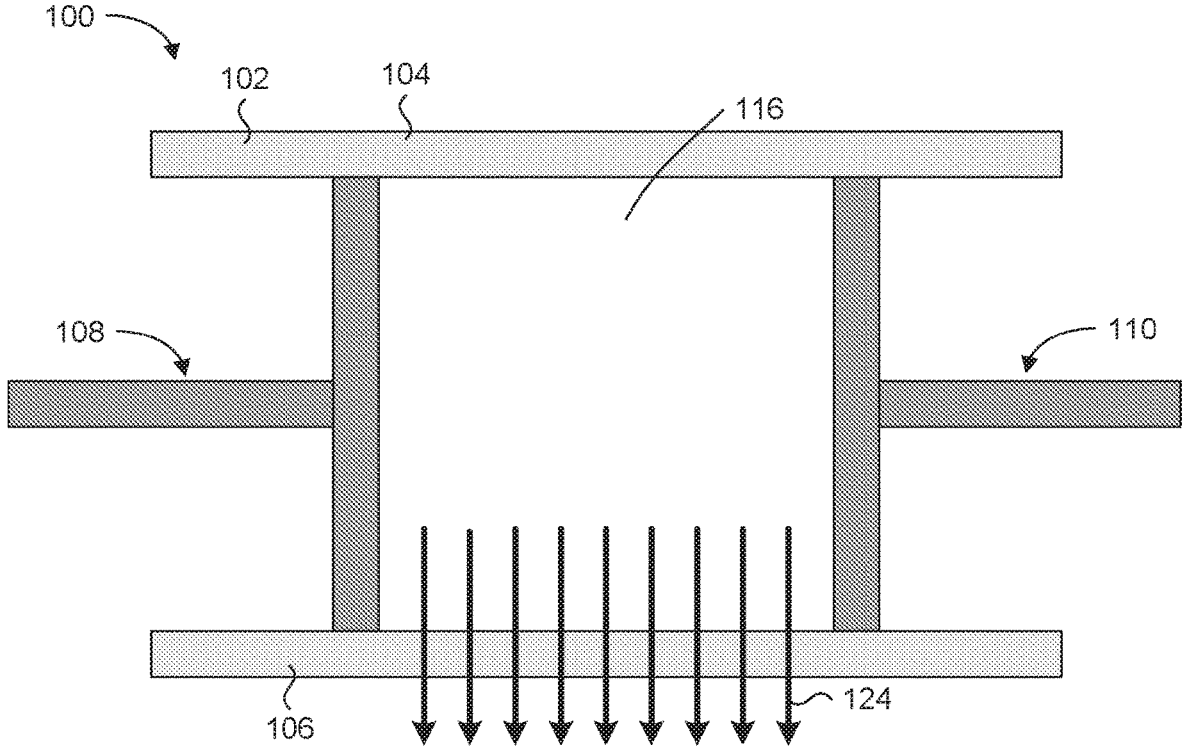

Referring now to FIGS. 1A and 1B, a cross-sectional view of an example actuator 100 having a working fluid as described above in order to utilize bidirectional thermal radiation transfer between the working fluid and the environment external is shown. The actuator 100 includes a housing 102. In the cross-sectional views shown in FIGS. 1A and 1B, a top portion 104 and a bottom portion 106 of the housing 102 is shown. The housing 102 may be, for example, cylindrically shaped, in which case the top portion 104 and bottom portion 106 shown in the cross-sectional view in FIGS. 1A and 1B are the top and bottom of a tube forming a part of the cylindrical housing. In another example, the housing 102 may have a rectangular cross-sectional area when viewed from the right or left in FIGS. 1A and 1B. In this example, the top portion 104 and bottom portions 106 are top and bottom walls, respectively, of the housing 102 that, together with sidewalls (not shown) extending from the top and bottom walls, form the sides of the housing 102.

In the example shown in FIGS. 1A and 1B, the housing 102 is also formed by a pair of plungers 108, 110. The plungers 108, 110 include heads 112, 114 that form end walls of the housing 102 such that housing 102 fully encloses and defines an enclosed volume region 116. The plungers 108, 110 also include shafts 118, 120 that may engage with an external system (not shown) that the actuator 100 does work on.

A working fluid is enclosed within the housing 102 in the enclosed volume region 116. As described above, the working fluid may include a compressible fluid and a suspension of EM radiation-absorbing solid elements that are distributed within the compressible fluid. The compressible fluid may be substantially transparent to EM radiation in a desired range of wavelengths of EM radiation and may be formed by, for example, one or more inert gases such as argon. The desired range of wavelengths may correspond to a range of blackbody EM radiation that is emitted by the working fluid at operating temperatures of the working fluid.

The plungers 108 and 110 are moveable within the other portions of the housing 102 such that the volume of the enclosed volume region may expand and contract. FIG. 1A shows the actuator 100 in a contracted state and FIG. 1B shows the actuator 100 in an expanded state. The working fluid exerts a pressuring on the housing 102 that may vary over time as the temperature of the working fluid increases and decreases.

The housing 102 includes an EM radiation transmitting portion formed from a material that enables transmission of EM radiation. The EM radiation transmitting portion facilitates EM radiation 122 being transmitted into the enclosed volume region 116 to heat the working fluid, and EM radiation 124 emitted by the working fluid to be emitted out of the enclosed volume region 116 to cool the working fluid. In the example actuator 100 shown in FIGS. 1A and 1B, the top portion 104 and bottom portion 106 are formed of EM radiation transmitting material to form the EM radiation transmitting portion of the housing 102. Additionally, or alternatively, the plungers 108, 110, or a portion thereof, may be formed of an EM radiation transmitting material. The EM radiation transmitting material may be any suitable material that sufficiently transmits EM radiation in a desired range of wavelengths of EM radiation. The desired range of wavelengths may correspond to a range of blackbody EM radiation that is emitted by the working fluid at operating temperatures of the working fluid. Examples of materials that may be suitable for forming the EM radiation transmitting portion include transparent materials that are able to withstand the typical operating temperatures present during operation of the actuator 100 such as, for example, quartz and mica.

In operation, EM radiation 122 is transmitted into the enclosed volume region 116 through the EM radiation transmitting portion of the housing 102. The EM radiation may be transmitted by a heating system (not shown). The heating system may include a light source comprising at least one of sunlight, an incandescent lamp, a light emitting diode, a gas discharge lamp, and a laser as a source of the EM radiation 122.

In the example shown in FIG. 1A, the EM radiation 122 is transmitted through the top portion 104 of the housing 102. However, in other examples the EM radiation may be transmitted through multiple different portions of the housing 102 such as, any of the bottom portion 106 and the plungers 108, 110. The EM radiation 122 is absorbed by the solid elements of the working fluid, heating the solid elements which in turn heat the compressible fluid. The compressible fluid expands, increasing the pressure that the working fluid exerts on the housing 102, which at least partially causes the plungers 108, 110 to move outward, away from each other and increase the volume of the enclosed volume region 116 such that the housing 102 is in the expanded state. In examples in which the plungers 108, 110 are coupled to an external mechanical system (not shown), the outward movement of the plungers 108, 110 may be predominately caused by movement of the mechanical system. The EM radiation 122 may heat the working fluid to a first temperature, averaged over the enclosed volume region 116, to transition the housing 102 from the contracted state to the expanded state.

When the transmission of the EM radiation 122 is stopped, the solid elements of the working fluid transmit EM radiation 124 which exits the housing 102 through the EM radiation transmitting portion, which radiatively cools the working fluid. The EM radiation 124 is emitted due to blackbody radiation of the solid elements. Although FIG. 1B shows EM radiation 124 being emitted through the bottom portion 106 only, it is understood that the EM radiation 124 is emitted by the solid elements in all directions and therefore will pass through the EM radiation transmitting portions of the housing 102 in all directions. In an example, the EM radiation transmitting portion of the housing 102 has an area and a transparency such that more than 25% of the thermal energy directed into the working fluid by the heating means is radiative emitted through the EM radiation transmitting portion as black body EM radiation emitted by the solid elements of the working fluid. As the working fluid cools due to the emission of the EM radiation 124, the pressure exerted by the working fluid on the housing 102 is reduced, which at least partially causes the plungers 108, 110 to move inwards and decrease the volume of the enclose volume region 116 such that the housing 102 moves to the contracted state. In examples in which the plungers 108, 110 are coupled to an external mechanical system (not shown), the inward movement of the plungers 108, 110 may be predominately caused by movement of the mechanical system. The emission of the EM radiation 124 may cool the working fluid to a second temperature, averaged over the enclosed volume region 116, to transition the housing from the expanded state to the contracted state.

In an example, the EM radiation 122 may be transmitted at predetermined intervals such that the movement of the actuator 100 between the expanded state and the contracted state is oscillatory. In other examples, the EM radiation 122 may be transmitted non-periodically such that movement of the plungers 108, 110 is non-oscillatory in order to produce movement of the plungers 108, 110 by a controlled amount. In an example, the transmission of the EM radiation 122 may be controlled by controller (not shown) that controls the heating system.

In some examples, the movement of the plungers 108, 110 may be constrained by, and in some cases at least partially caused by, the external system to which the plungers 108, 110 are coupled. The constrained movement of the plungers 108, 110 results in the volume of the enclosed volume region 116 being constrained between a minimum volume and a maximum volume. A characteristic dimension of the enclosed volume region 116 may be defined as the cube root of the average of the minimum and maximum volumes of the enclosed volume region. Further, a characteristic operating temperature of the working fluid may be defined as the mean value of the spatial averaged absolute temperature of the working fluid over the enclosed volumetric region 116 during operation of the actuator 100 when the enclosed volume region 116 is equal to the average of the maximum and minimum volumes. Alternatively, the characteristic operating temperature may be an average of the first temperature to which the working fluid is heated to by absorption of the EM radiation 122 and the second temperature to which the working fluid is cooled by emission of the EM radiation 124.

The characteristic dimension of the enclosed volume region 116, and the characteristic operating temperature may be utilized as desired parameters to be met when determining suitable working fluids suitable for use in the actuator 100. For example, the solid elements of the working fluid may be selected such that solid elements comprise a material that has an effective broadband light absorptivity of greater than $10^6$ $m^{-1}$, for EM radiation having wavelengths ranging from one half of the wavelength of peak emission for a black body radiator at a temperature equal to the characteristic operating temperature, to twice the wavelength of peak emission. The solid elements may have a thickness that is substantially less than the inverse of the broadband light absorptivity, i.e., substantially less than $10^{-6}$ m. The relative amount of solid elements that are included in the working fluid may be such that the solid elements occupy a fraction of the enclosed volume region 116 that is of the order of the inverse of the product of the broadband light absorptivity and the characteristic dimension of the enclosed volume.

The thermal conductivity of the compressible fluid should be sufficiently large, and the average physical separation between the solid elements should be sufficiently small, that the thermal equilibration time between the solid elements and the compressible fluid is substantially less than the time required for black body radiation emitted from the solid elements to reduce the absolute temperature of the working fluid by 25%.

Examples of suitable material for the solid elements of the working fluid may include a substantially one dimensional (1D) material, such as, for example, nanotubes of carbon or tungsten, or a substantially two dimensional (2D) material, such as graphene. In an example, sheets of the substantially 2D materials may be separated by separators. The separators may be comprised of, for example, substantially 1D materials such as, for example, nanotubes or bundles of nanotubes. An example of a material comprised of sheets of 2D materials separated by separators is described in more detail below with reference to FIG. 3.

Figure 5:
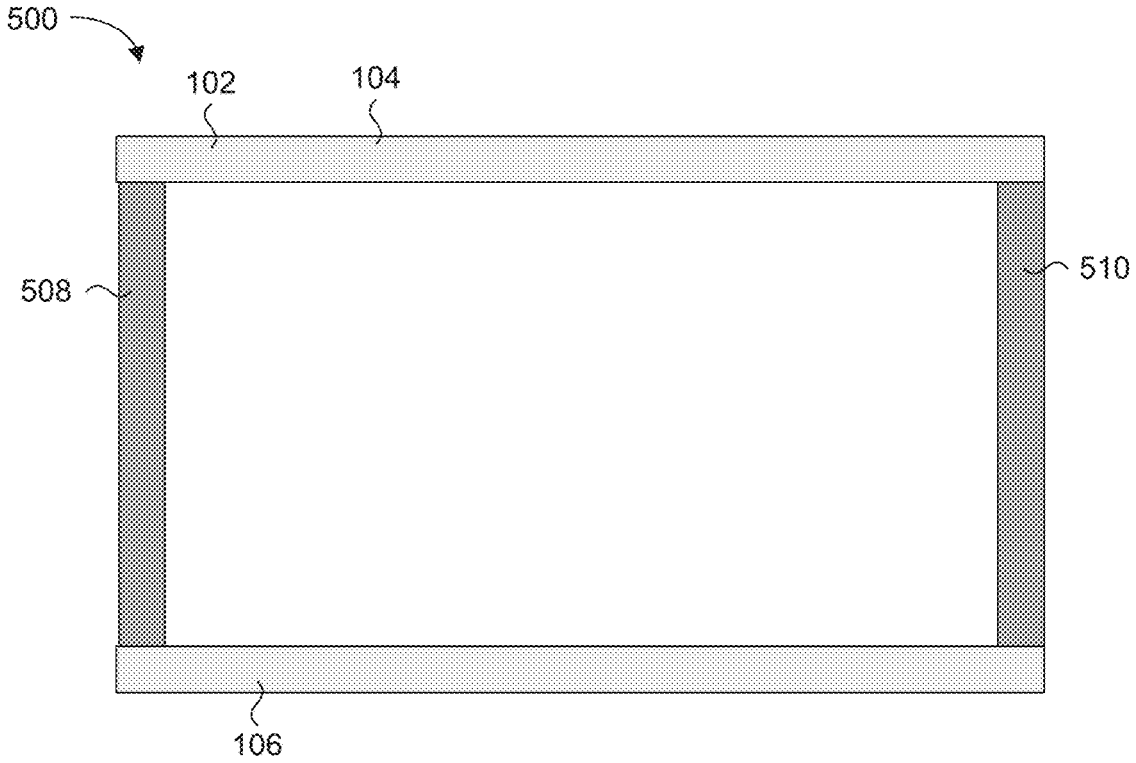
FIG. 5 is a cross-sectional view of another example actuator device according to another embodiment of the present disclosure.

Although the example shown in FIGS. 1A and 1B includes two plungers 108, 110, other embodiments may include greater or fewer than two plungers. For example, the housing 102 may include one plunger 108, and the second plunger 110 may be replaced with a fixed end wall. In another example, both plungers 108, 110 may be replaced with end walls 508, 510 as shown in the example actuator 500 shown in FIG. 5. In this example, one or more surfaces 104, 106, 508, 510 of the housing 102 may be flexible such that the surface may flex to expand and contract the housing between the expanded and contracted states.

Figure 2:
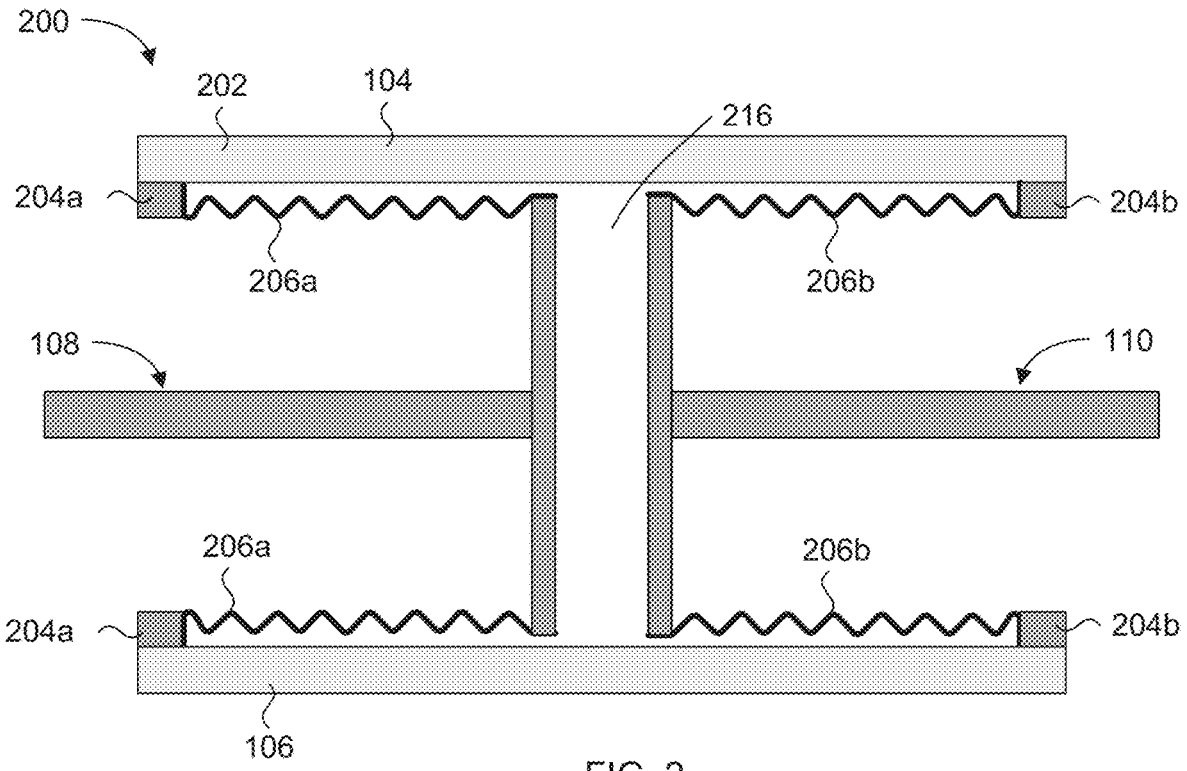
FIG. 2 is a cross-sectional view of another example actuator device according to another embodiment of the present disclosure.

The plungers 108, 110 may include a seal to inhibit the working fluid from leaking out of the enclosed volume region. The seal may comprise any suitable type of seal. Referring to FIG. 2, an example of a seal for an actuator 200 is shown. FIG. 2 shows a cross sectional view of a heat engine that is substantially similar to the actuator 100, and includes a housing 202 comprising a top portion 104, a bottom portion 106, and plungers 108, 110 substantially similar to the actuator 100. The housing 202 also includes protrusions 204*a*, 204*b*. A bellows 206*a* extends between the protrusion 204*a* and the plunger 108, and a bellows 206*b* extends between the protrusion 204*b* and the plunger 110. The housing 202 and the bellows 206*a*, 206*b* define the enclosed volume region 216. The bellows 206*a*, 206*b* may be formed of, for example, a deformable material. In an example, the deformable material is a metal. Utilizing a bellows system as shown in FIG. 2 to seal the enclosed volume region reduces the friction between the plungers 108, 110 compared with seals that are pressed between the plungers 108, 110 and the rest of the housing. The reduction in friction may result in increased efficiency of the actuator 200, and also inhibits frictional wear on the seal that may result in failure of the seal and leakage of the working fluid from the enclosed volume region.

In another embodiment, rather than bidirectional radiation heat transfer between the working fluid and the environment, heating may be performed by some other mechanism other than radiative heating such that only the cooling cycle substantially involves radiative heat transfer. In an example, the solid elements may be an electrically conductive material, such as for example graphene sponge, or some other material having an emissivity that corresponds to the desired absorptivity described above, such electricity may be conducted through the working fluid. In this example, heating of the working fluid is provided by passing an electrical current through the working fluid. Cooling is provided by radiative cooling due to EM radiation emitted by the solid element(s) being transmitted to the environment external to the heat engine. In order to provide sufficient radiative cooling, it may be desirable that the solid element of the working fluid be formed of a material having an emissivity corresponding to the desired absorptivity described above. Namely, an effective broadband light emissivity of greater than $10^6$ $m^{-1}$, for EM radiation having wavelengths ranging from one half of the wavelength of peak emission for a black body radiator at a temperature equal to the characteristic operating temperature, to twice the wavelength of peak emission.

As stated above, one suitable material for the solid elements of the working fluid is graphene. To understand the significance of graphene for use in a working fluid, it is helpful to review the quantitative aspects of radiative cooling, which differs from the exponential decay of conductive cooling, since the intensity of Planckian radiation is proportional to the fourth power of temperature. This difference may be illustrated by considering a thin slab of planar material of infinite extent, surrounded by vacuum, that is also free of electromagnetic radiation and therefore has a radiation temperature of 0 K. All cooling is via thermal radiation emitted from the slab's two surfaces. The slab has a specific heat per unit area $\overline{C}_V$ and its emissivity is ε. T(t) is the time dependent temperature with $T(0)=T_o$ of the slab. The radiated power per unit area, Q, is given by the Stefan-Boltzmann law:

$$Q=2\varepsilon\delta T^4 \qquad \text{Equation 6,}$$

where the Stefan-Boltzmann constant $\delta=5.67\times10^{-8}$ $Wm^{-2}K^{-4}$ and the factor of 2 accounts for radiation leaving from both surfaces.

To an approximation that is sufficient for the following analysis, the specific heat and emissivity can be modeled as being temperature-invariant, and the temperature of the slab, at any given time, uniform. The rate of cooling is then given by:

$$\frac{dT}{dt} = -\frac{2\varepsilon\sigma}{\overline{C}_V}T^4. \qquad \text{Equation 7}$$

The decay form satisfying Eq. (7) is:

$$T = T_0\left(1+\frac{t}{\Delta}\right)^{-1/3}, \text{ where } \Delta = \frac{\overline{C}_V}{6\varepsilon\sigma}T_0^{-3}. \qquad \text{Equation 8}$$

The quantity Δ can be thought of as a characteristic time for radiative thermal decay. One way to interpret the characteristic time is that when t=7Δ, $T=T_o/2$. The characteristic time Δ may be calculated for different materials. For example, a typical tungsten incandescent lamp filament has a thickness of $10^{-4}$ m and emissivity of 0.33. A slab of tungsten with the same thickness as the lamp filament would have a value $C_V$ of $2.59\times10^2$ $J/m^2K$ and, at the typical operating temperature of 2,750 K, the characteristic time Δ given by Eq. (8) is 0.11 s. Therefore, the tungsten slab cools to half its original temperature (i.e. to 1,375 K) in 0.77 s.

It should be pointed out that the above calculation is not exact because in general the ambient radiative environment is above absolute zero. For example, in practice it would often be around room temperature, approximately 300 K. However, this is not a consequential issue because the intensity of blackbody radiation varies in direct proportion to $T^4$. Thus, the incident thermal radiation would reduce the cooling speed in this example by only 0.014%. For simplicity, we omit the effects of the radiative environment.

A single sheet of graphene absorbs a fraction of about 0.023 of perpendicular incident light, and this absorption depends very weakly on incident direction or wavelength. Therefore, the sheet has a broadband emissivity of about 0.023. It also has a value of $\overline{C}_V$ of about $1.5\times10^{-3}J/m^2K$ at high temperatures. At 2,750 K, the characteristic time Δ for radiative decay calculated using Eq. (8) is about $9\times10^{-6}$ s. Thus, a free graphene monolayer cools via thermal radiation about five orders of magnitude faster than a tungsten filament. Further, despite the very low thickness of single graphene layers, their extreme tensile strength in the direction parallel to the sheet makes it feasible for them to span macroscopic distances that are desired for use as the solid elements of a working fluid.

Figure 3:
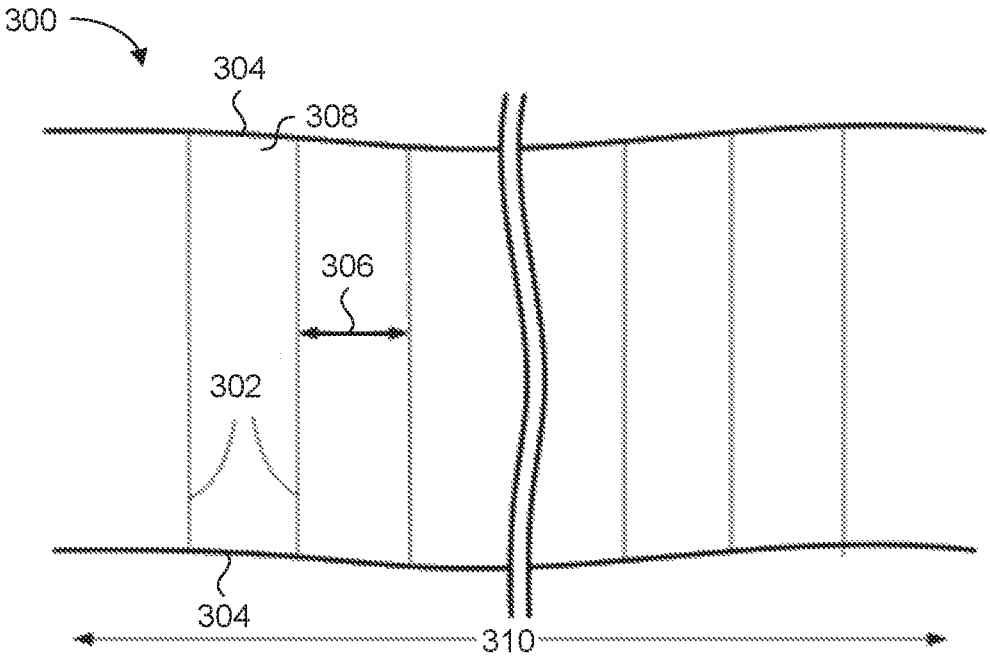
FIG. 3 is a schematic view of a multi-layer structure according to an embodiment of the present disclosure.

Referring to FIG. 3, a schematic diagram of an example multi-layer structure 300 for use as solid elements of a working fluid is shown. The multi-layer structure consists of multiple layers 302 of a substantially 2D material. The 2D material may be for example, sheets of graphene. The sheets of graphene may be ordered or disordered graphene sheets. The layers 302 are separated by separators 304 such that adjacent layers 302 are separated by a distance 306. In an example, the separation between the layers 302 may be about ten microns. The separators may be formed of a substantially 1D material such as, for example, nanotubes or nanowires of carbon or tungsten, or bundles of nanotubes or nanowires. The compressible fluid fills the gaps 308 between layers 302. The compressible fluid may be, for example, an inert gas such as argon. In an example, one hundred layers 302 may be provided such that the overall thickness 310 is one millimeter for a separation 306 between layers of ten microns. In practice, the multi-layer structure 300 may include any number of units of layers 302 separated by separators 304 shown in FIG. 1.

Despite the nano-scale thickness of graphene, sheets of macroscopic extent may be practical for use as solid elements in a working fluid because three-dimensional graphene structures may be repeatedly expanded and contracted in response to external pressure while remaining substantially structurally intact.

Further, given the very low value of absorptivity (equal to emissivity of roughly 0.023), each graphene sheet is substantially transparent (97.7%), which means that, in a multi-layer structure, such as the example multilayer structure 300 shown in FIG. 3, each sheet is able to substantially and independently exchange radiant heat, both incoming and outgoing radiation, with the surrounding thermal environment, substantially independent of the other layers. It is noted that ignoring other layers is an approximation and that, in principle, there will be small amounts of interaction between the separate graphene sheets. However, even with much more proximate multilayers, the average amount of absorption per unit thickness changes little with decreased spacing between the layers, and therefore treating the thermal interaction of the layers as independent is a reasonable approximation to model layers that are separated by 10 nm.

This characteristic of being able to exchange radiant heat with the surrounding thermal environment, substantially independent of the other layers, makes graphene multi-layer structured desirable materials for use in a working fluid and that may yield practical power densities when incorporated into a heat engine.

A key concept for the working fluid is that its temperature should be substantially uniform, on the time scale of the planned thermodynamic cycle. This requires the thermal equilibration time between the graphene and the argon to be sufficiently short. This is easily calculated in this range of temperature, pressure, and size scale, for which there is negligible thermal convection and the mean free path for the argon atoms is considerably less than d. In this regime, the thermal equilibration time is reasonably accurately described by the thermal diffusion equation and is given approximately by:

$$\tau \cong \frac{s^2 \rho C_v}{k}, \qquad \text{Equation 9}$$

where k, ρ, $C_v$, are, respectively, the thermal conductivity, density, and specific heat of argon at T=300 K and P=$10^5$ Pa ($1.79\times10^{-2}$ W/mK, 1.607 kg/m$^3$, $3.13\times10^2$ J/kgK). The variables is a general variable for "size scale" in diffusion settings. In the example of the multilayer structure 200 shown in FIG. 2, the relevant size scale, s, is the distance 306 between layers 302, so in equation 9, s may be the distance 306 between layers 302. Here, the bulk value for the thermal conductivity of argon is a reasonable approximation to use because the mean free path of argon is smaller than the spacing of the graphene layers, as shown next.

For the dimensions of the example multi-layer structure 300 shown in FIG. 3, the characteristic equilibration time τ given by Eq. (9) is $2.81\times10^{-6}$ s. This relatively short characteristic equilibrium time arises because the distance 306 between layers 302 is small and raised to the power two. Because this time is much shorter than the radiative cooling time (which in the example below is 1000 times longer), it is a good approximation to simply model the argon and graphene as always being essentially equal in temperature.

The 100 layers of graphene contribute a heat capacity per unit area of $1.5\times10^{-1}$ J/m$^2$K. The argon contributes a specific heat per unit area at constant volume of $\overline{C_{va}}=5\times10^{-1}$ J/m$^2$K, yielding a hybrid value of $\overline{C_{vh}}=6.5\times10^{-1}$ J/m$^2$K. Similarly, the argon contributes a specific heat per unit area at constant pressure of $\overline{C_{pa}}=wC_{pa}=8.33\times10^{-1}$ J/m$^2$K, yielding a hybrid value of $\overline{C_{ph}}32\ 9.83\times10^{-1}$ J/m$^2$K. Thus the specific heat ratio $\gamma=\overline{C_{ph}}/\overline{C_{vh}}=1.513$, a value that is intermediate between that for a monotonic gas, 1.67, and that for a diatomic gas, 1.4, which is equivalent to a gas with about four degrees of freedom. This is mentioned here mainly to show that the presence of the dispersed graphene within the working fluid does not fundamentally alter the thermodynamic characteristics of the gas as a heat engine working fluid, but it does enable substantial direct thermal exchange with the environment. Of course this simple conceptual model is only approximate, but as in other idealized thermodynamic calculations, such as that for the Carnot cycle, it enables a helpful conceptual understanding of this system. In particular, it is instructive for calculating the efficiency of a simple thermal cycle. A cycle for this purpose traces the path in PV space shown in the graph of FIG. 4.

Figure 4:
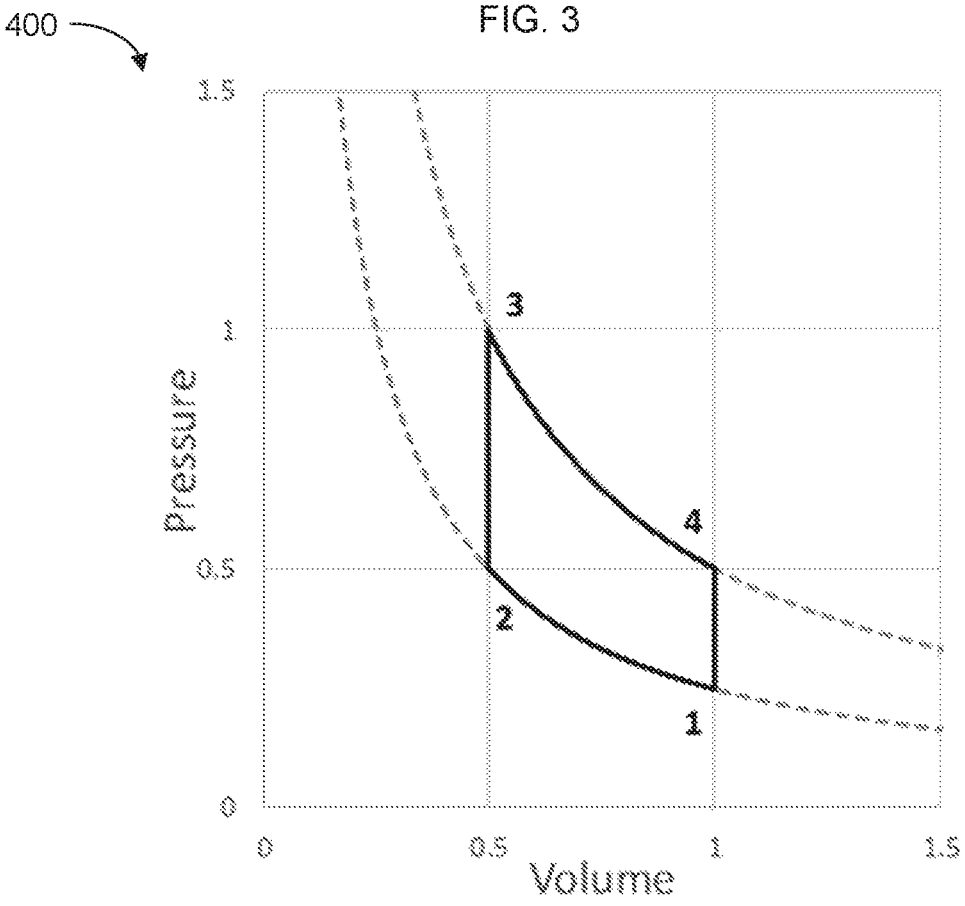
FIG. 4 is a graph of a cycle of a Carnot engine according to the present disclosure.

Using the standard formulas for adiabatic expansion and contraction, the values for the pressure P, the width w and the temperature T for the four points in FIG. 4 are shown in the following table:

| Point # | P (kPa) | w (mm) | T (K) | $Q_{in}$ (J/m$^2$) | $W_{out}$ (J/m$^2$) |
|---|---|---|---|---|---|
| 1 | 333 | 1.0 | 1,000 | 0 | −277 |
| 2 | 951 | 0.5 | 1,427 | 396 | 0 |
| 3 | 1,357 | 0.5 | 2,036 | 0 | 396 |
| 4 | 476 | 1.0 | 1,427 | −277 | 0 |
| Sum | — | — | — | 118 | 118 |

The columns $Q_{in}$ and $W_{out}$ in the table refer to energy exchange during the transition from each cycle point to the next.

The mechanical work input required for the transition 1 to 2 is 277 J/m$^2$. Transition 2 to 3 requires a radiative heat input of 396 J/m$^2$. Transition 3 to 4 provides a mechanical work output of 396 J/m$^2$. Finally, the transition from 4 to 1 yields a radiative heat output of 277 J/m$^2$. The net output of work per cycle is 118 J/m$^2$, and thus the efficiency in this example is 30%. By design, the cycle time is dominated by transition 4 to 1, and can be calculated using Eq. (8): Estimating the emissivity at 0.9, the radiative cooling transition requires 1.4 ms. The operating frequency is therefore 714 Hz, corresponding to an average mechanical output power of 85 kW/m$^2$.

The mass per unit area of the hybrid working fluid is $1.45\times10^{-3}$ kg/m$^2$ and likely negligible compared to the power coupling system. A simple coupling system could be a planar mass that resonates with the effective spring constant of the hybrid working gas, estimated in this case to require about 45 kg/m$^2$. More sophisticated magnetic couplers might require significantly less mass. Thus, the specific power could be 1.9 kW/kg or more. In comparison, the best specific power for Stirling engines is about 0.3 kW/kg, and many automotive internal combustion engines produce less than 1.9 kW/kg.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described.

Generally, the concepts described above could be applied in a wide variety of size scales and geometries. The invention may be used to provide muscle-like actuation, for example in mobile robots. Another application may be autonomous aircraft, wherein sunlight would provide the radiant heat, enabling direct conversion of solar radiation to mechanical power for rotor systems. Although the present disclosure describes graphene sheets as the model material in order to simplify the analysis, the basic concept, that of a highly absorptive medium with low thermal mass based on an extremely porous nanostructure, is equally amenable to other embodiments, for example based on graphene sponges, large-scale sheets of carbon nanotubes, or even hybrid structures combining carbon nanotube networks and graphene layers. The specific application to which the actuator device is utilized will determine the size and scale of the device, which will in turn dictate the choice of material to form the working fluid based on available technologies, as described herein. For example, a miniature device might use ordered sheets of single-layer graphene, while a larger-scale device might require more robust and less ordered structures such as graphene-nanotube composites.

In the preceding description, for purposes of explanation, numerous details are set forth in order to provide a thorough understanding of the embodiments. However, it will be apparent to one skilled in the art that these specific details are not required. In other instances, well-known electrical structures and circuits are shown in block diagram form in order not to obscure the understanding. For example, specific details are not provided as to whether the embodiments described herein are implemented as a software routine, hardware circuit, firmware, or a combination thereof.

The above-described embodiments are intended to be examples only. Alterations, modifications and variations can be effected to the particular embodiments by those of skill in the art without departing from the scope, which is defined solely by the claims appended hereto.

What is claimed is:

1. An actuator device comprising:

a housing that defines an enclosed volume region, the housing comprising a movable surface such that at least a portion of the housing is expandable between an expanded state to a contracted state, and the enclosed volume region having a characteristic dimension that is defined as a cube root of an average of a volume of the enclosed volume region in the expanded state and in the contracted state;

a working fluid within the enclosed volumetric region, the working fluid comprising a substantially transparent compressible fluid and electromagnetic (EM) radiation-absorbing solid elements distributed within the compressible fluid, wherein the solid elements have an absorptivity in a particular range of EM radiation wavelengths, and wherein the solid elements have a thickness substantially less than the inverse of the absorptivity and occupy a fraction of the enclosed volume that is of the order of the inverse of the product of the absorptivity and the characteristic dimension of the enclosed volume region;

a heating system for directing thermal energy into the working fluid at predetermined times; and wherein the housing includes an EM radiation transmitting portion having a sufficient area and a sufficient transparency such that more than 25% of the thermal energy directed into the working fluid by the heating means is radiative emitted through the EM radiation transmitting portion as black body EM radiation emitted by the solid elements of the working fluid.

2. The actuator device according to claim 1, wherein the movable surface comprises a plunger moveable within the housing, wherein the plunger and the housing define the enclosed volume region.

3. The actuator device according to claim 2, wherein the plunger is substantially transparent to the EM radiation emitted from the absorptive material such that the plunger forms at least a portion of the EM radiation transmitting portion.

4. The actuator device according to claim 2, further comprising a seal disposed between the plunger and the rest of the housing to inhibit the working fluid from leaking out of the enclosed volume region.

5. The actuator device according to claim 4, wherein the seal comprises a bellows formed of a deformable material.

6. The actuator device according to claim 1, wherein the solid elements comprise a substantially one-dimensional (1D) material.

7. The actuator device according to claim 6, wherein the substantially 1D material is at least one of tungsten nanotubes and carbon nanotubes.

8. The actuator device according to claim 1, wherein the solid elements comprise a substantially two-dimensional (2D) material.

9. The actuator device according to claim 8, wherein the substantially 2D material comprises graphene sheets.

10. The actuator device according to claim 9, wherein the graphene sheets comprise at least one of ordered graphene sheets and disordered graphene sheets.

11. The actuator device according to claim 9, wherein the graphene sheets are separated by spacers.

12. The actuator device according to claim 11, wherein the spacers comprise a substantially one-dimensional (1D) material.

13. The actuator device according to claim 12, wherein the 1D material comprises nanotubes or nanotube bundles.

14. The actuator device according to claim 1 further comprising a control unit connected to the heating system to control the heating of the working fluid provided by the heating system.

15. The actuator device according to claim 14, wherein the heating system is configured to provide EM radiation to the working fluid to radiatively heat the working fluid during the expansion stage, and the control unit is configured to control the EM radiation provided by the heating system.

16. The actuator device according to claim 15, wherein the heating system includes at least one of an incandescent lamp, a light emitting diode, a gas discharge lamp, and a laser as a source of EM radiation.

17. The actuator device according to claim 14, wherein the control unit is configured to control the heating provided by the heating system to heat the working fluid periodically at a predetermined period.

18. The actuator device according to claim 14, wherein the control unit is configured to control the heating provided by the heating system to heat the working fluid non-cyclically to produce expansion of the working fluid by a controlled amount during the expansion stage.

19. The actuator device according to claim 14, wherein the solid elements are electrically conductive such that the working fluid is electrically conductive, and the heating system is configured to provide an electronic current through the working fluid to resistively heat the working fluid during the expansion stage.

20. The actuator device according to claim 15, wherein the solid elements comprise graphene sponge.

21. The actuator device according to claim 1, wherein, during operation, the working fluid is heated to a first temperature, averaged over the enclosed volume region, to move the housing from the contracted state to the expanded state, and is cooled to a second temperature that is less than the first temperature, averaged over the enclosed volume region, to move the housing from the expanded state to the contracted state; and wherein the absorptivity is greater than $10^6$ $m^{-1}$ and the particular range of EM radiation wavelengths is a range from one-half of a peak emission wavelength of a black body radiator at a temperature that is an average of the first and second temperatures to twice the peak emission wavelength.

22. The actuator device according to claim 1, wherein an average physical separation between solid elements in the working fluid is such that the thermal equilibration time between the solid elements and the compressible fluid is substantially less than the time required for black body radiation emitted from the solid elements to reduce the absolute temperature of the working fluid by 25%.

* * * * *